US005461833A

United States Patent [19]

Murray et al.

[11] Patent Number: 5,461,833

[45] Date of Patent: Oct. 31, 1995

[54] EASY-UP SAND ANCHOR

[76] Inventors: John J. Murray, 22 Elm St., Chester, N.J. 07930; James P. Murray, 81 Hamilton Ave., Atlantic Beach, N.Y. 11509

[21] Appl. No.: 284,087

[22] Filed: Aug. 1, 1994

[51] Int. Cl.[6] ..... E02D 5/74

[52] U.S. Cl. ..... 52/155; 52/148; 52/163; 248/156

[58] Field of Search ..... 52/148, 155, 158, 52/160, 162, 163, 166; 114/299, 300, 294, 297; 24/122.6; 248/156; 256/13.1

[56] References Cited

U.S. PATENT DOCUMENTS

| | | | |
|---|---|---|---|
| 809,374 | 1/1906 | Holden | 52/163 |
| 847,320 | 3/1907 | Crane | 114/300 |
| 2,372,868 | 4/1945 | Warren | 256/13.1 |
| 2,892,518 | 6/1959 | Fiske | 52/163 |
| 2,973,065 | 2/1961 | Cordes | 52/163 |
| 4,098,041 | 7/1978 | Frye | 52/155 |
| 5,176,344 | 1/1993 | Eberhard | 248/156 |
| 5,342,229 | 8/1994 | Whitt | 114/294 |

*Primary Examiner*—Randolph A. Reese
*Assistant Examiner*—Howard N. Shipley

[57] ABSTRACT

A general purpose sand anchor, including: a paddle shaped anchor base, curved like the face of a spade shovel, for use as a hand-held shovel for digging the hole into which it will be placed; a line, with one end joined to the anchor base at the center of its wider part and the other end joined to the anchor base at the end of its narrower part; a hook, which attaches to an object to be secured, joined to the line at a point above its connection to the center of the wider part of the anchor base; and a handle, which is used to remove the anchor base from the sand, joined to the line at a point above its connection to the end of the narrower part of the anchor base.

15 Claims, 3 Drawing Sheets

EASY-UP SAND ANCHOR

BACKGROUND-FIELD OF INVENTION

This invention relates to the field of anchors, specifically to land anchors of the deadman variety, for use in sand or soft earth.

BACKGROUND-DESCRIPTION OF PRIOR ART-FIG. 1

Conventional sand anchors are used, for example, to hold portable beach volleyball nets in place during volleyball play and are removed from the sand at the end of play.

As illustrated in FIG. 1, conventional sand anchors typically consist of a nylon anchor line 38 connected at one end to a flat, disk-shaped, plastic anchor base 10. To achieve this connection, anchor line 38 passes through a hole 8 in the center of anchor base 10 and is held in place with a knot 14 at its end below anchor base 10. The other end of anchor line 38 is tied with a loop and knot 40 to a metal S hook 34, which is closed into a ring at its lower end and remains open as a hook at its upper end.

A portable beach volleyball net typically has four support lines, two for each of the two volleyball net poles. Therefore, four sand anchors are required to secure one volleyball net, one sand anchor for each of the four support lines. To do so, each anchor base 10 is buried horizontally in the sand, one to two feet below the surface. S hook 34 remains visible above the surface of the sand and is connected to a volleyball net support line. The four support lines are then tightened to hold the net securely in place during volleyball play.

The problem with conventional sand anchors is that they are difficult to remove from the sand at the end of volleyball play. Doing so requires either considerable strength and effort to pull anchor base 10 to the surface or digging a hole to retrieve it from the sand. Neither option is attractive after a fun but often exhausting day of beach volleyball play. Moreover, attempting to pull anchor base 10 to the surface with anchor line 38 can cause injury.

OBJECTS AND ADVANTAGES

The Easy-Up Sand Anchor (FIG. 2 for basic form and FIG. 3 for advanced form) solves the problem of anchor removal described above under Background-Discussion of Prior Art. As illustrated in FIG. 2, it does so with the introduction of a second nylon line, the easy-up line 22. Easy-up line 22 permits anchor base 10 to be easily pulled to the surface after volleyball play, with no detraction from the anchor's ability to hold the net securely in place during play. Greatly facilitating the heretofore arduous task of anchor removal will enhance the overall enjoyment of beach volleyball. More important, however, for volleyball and for all other sand anchor applications, the Easy-Up Sand Anchor will prevent injuries which might otherwise occur from attempting to pull conventional sand anchors to the surface.

In addition to facilitating the removal of anchor base 10 from the sand, the advanced form Easy-Up Sand Anchor (FIG. 3) facilitates anchor base 10 burial. The shape of anchor base 10 in the advanced form Easy-Up Sand Anchor permits it to serve as a very effective hand-held shovel for digging the hole into which it will be placed.

Further objects and advantages of this invention will become apparent from a consideration of the drawings and ensuing descriptions.

Figure 1:
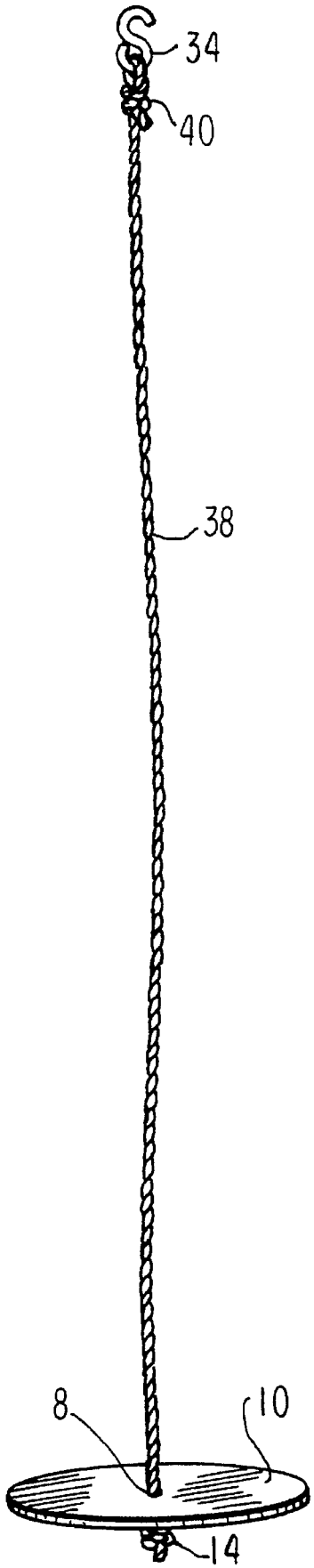
FIG. 1 shows a conventional sand anchor as described under Background-Description of Prior Art.

| List of Reference Numerals | | Illustrated in FIGS. |
|---|---|---|
| 8 | hole (in center of anchor base) | 1, 2, and 3 |
| 10 | anchor base | 1, 2, and 3 |
| 12 | slightly sharpened edge at wider part of paddle shaped anchor base | 3 |
| 14 | knot (at end of anchor line, below hole in center of anchor base) | 1, 2, and 3 |
| 16 | knot (at end of easy-up line, below hole near edge of anchor base) | 2 and 3 |
| 18 | slightly sharpened edge at the narrower part of tear-drop shaped anchor base | 3 |
| 20 | hole (near edge of anchor base) | 2 and 3 |
| 22 | easy-up line | 2 and 3 |
| 24 | knot (below handle) | 3 |
| 26 | handle | 2 and 3 |
| 28 | knot (above handle) | 2 and 3 |
| 30 | connecting line | 3 |
| 32 | knot (before S hook) | 3 |
| 34 | S hook | 1, 2, and 3 |
| 36 | knot (after S hook) | 3 |
| 38 | anchor line | 1, 2, and 3 |
| 40 | loop and knot (around lower end of S hook) | 1 and 2 |

DESCRIPTION OF INVENTION-FIGS. 2 AND 3

Figure 2:
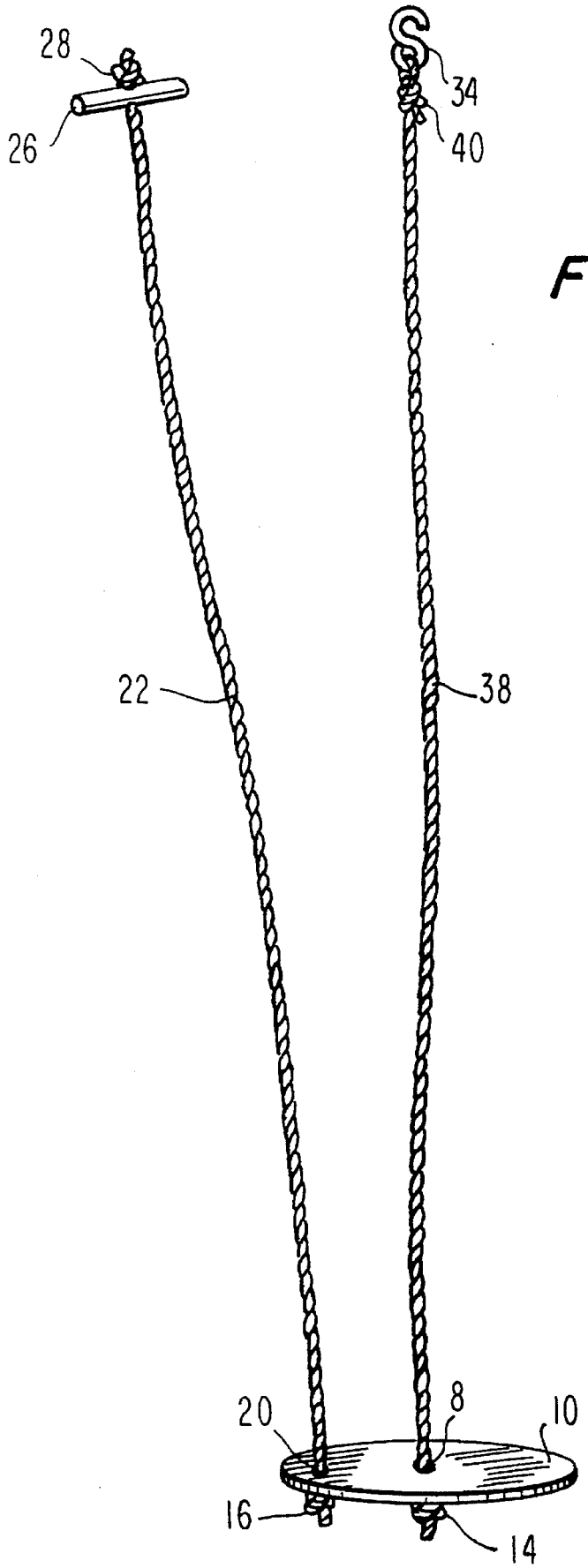
FIG. 2 shows the Easy-Up Sand Anchor in its basic form.

The Easy-Up Sand Anchor in its basic form is illustrated in FIG. 2. Disk-shaped, plastic anchor base 10 (approximately 20 cm in diameter and 1 cm thick), hole 8, nylon anchor line (approximately 90 cm long), knot 14, loop and knot 40, and metal S hook 34 are identical in form and in manner of connection to the conventional sand anchor described in Background-Description of Prior Art and illustrated in FIG. 1. The key to the Easy-Up Sand Anchor in its basic form (FIG. 2) is the addition of a second nylon line, the easy-up line 22 (approximately 90 cm long). The lower end of easy-up line 22 extends through a hole 20 near the edge of anchor base 10. Easy-up line 22 is held in place with a knot 16 at its end below anchor base 10. Easy-up line 22 connects at its other end to a wooden or plastic cylinder shaped handle 26. This connection is accomplished by easy-up line 22 passing through a hole (not shown) in handle 26, with a knot 28 at the end of easy-up line 22 to hold handle 26 in place.

Figure 3:
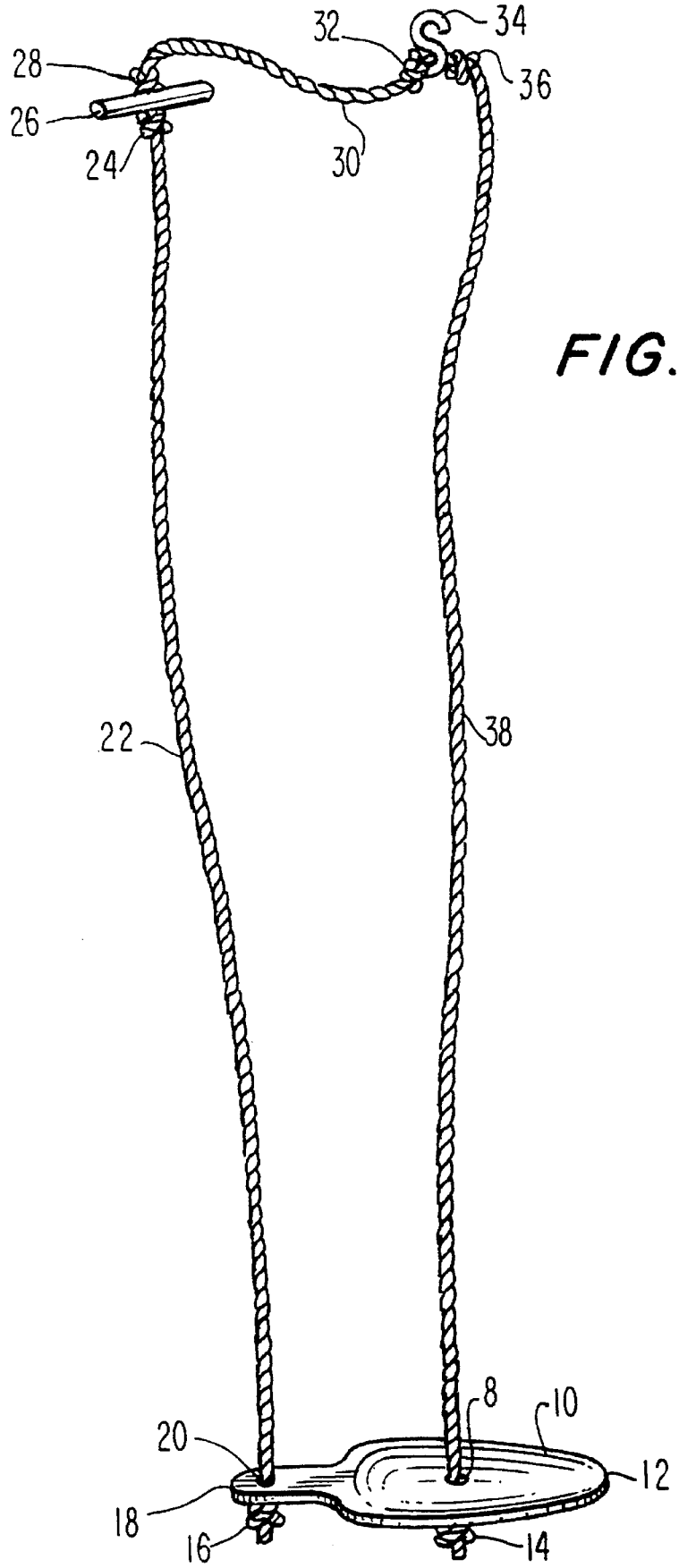
FIG. 3 shows the Easy-Up Sand Anchor in its advanced form.

The Easy-Up Sand Anchor in its advanced form is illustrated in FIG. 3. Improvements over the basic form Easy-Up Sand Anchor described above include the following:

a) A replacement of the disk-shaped, plastic anchor base with a paddle shaped, plastic anchor base 10, curved like the face of a spade shovel (approximately 20 cm long, 15 cm wide at its widest part, 5 cm wide at its narrowest part, and 1 cm thick). Hole 8 is located at the center of the wider part of anchor base 10. Hole 20 is located near edge 18 of the narrower part of anchor base 10. Edge 12 of the wider part of anchor base 10 and edge 18 of the narrower part of anchor base 10 are slightly sharpened, although not enough to cause injury when handled.

b) The addition of a nylon connecting line 30 (approximately 20 cm long), from handle 26 to the lower closed end of S hook 34.

In addition to providing added functionality and advantage as described under Operation below, connecting easy-up line 22 and anchor line 38 in the manner described above facilitates and strengthens construction of the advanced form Easy-Up Sand Anchor (FIG. 3). It does so by permitting one continuous nylon cord to satisfy the needs of easy-up line 22, connecting line 30, and anchor line 38. This single cord begins at knot 16 below anchor base 10 and extends up through hole 20 of anchor base 10. It continues up and through the hole (not shown) of handle 26, holding handle 26 in place with a knot 24 and knot 28, immediately below and above handle 26, respectively. It proceeds through the lower closed end of S hook 34, holding S hook 34 in place with a knot 32 immediately preceding it and with a knot 36 immediately following it. The single cord continues down through hole 8 of anchor base 10 and terminates in knot 14.

Although the advanced form Easy-Up Sand Anchor (FIG. 3) will be constructed with a single cord as described above, all ensuing descriptions will continue to reference easy-up line 22, connecting line 30, and anchor line 38 as if they are separate entities. Doing so will simplify description of operation and facilitate further discussion of objects and advantages.

OPERATION OF INVENTION-FIGS. 2 AND 3

The basic form Easy-Up Sand Anchor (FIG. 2) operates as and performs all functions of the conventional sand anchor described under Background-Discussion of Prior Art and illustrated in FIG. 1. That is, it can effectively hold objects in place. To accomplish this task, anchor base 10 is buried horizontally in the sand, one to two feet below the surface. Anchor line 38 extends above the surface and the upper hooked end of S hook 34 is attached to the object to be secured, such as the support line of a portable beach volleyball net.

With no detraction from its ability to hold objects in place as described above, the basic form Easy-Up Sand Anchor (FIG. 2) achieves a significant functional improvement and major advantage over conventional sand anchors. It does so by the introduction of easy-up line 22, which permits anchor base 10 to be easily removed from the sand in the following manner. When anchor base 10 in buried horizontally, one to two feet below the surface of the sand, handle 26 remains visible above the surface. Pulling up on handle 26 easily brings anchor base 10 to the surface. The key to this invention is that easy-up line 22 connects near the outer edge of anchor base 10. Thus, pulling up on handle 26 turns-anchor base 10 from a horizontal to a vertical position in the sand. This greatly minimizes sand weight and resistance on anchor base 10, permitting it to move easily to the surface. It should be noted that pulling up on anchor line 38 requires considerable strength and effort to remove anchor base 10 from the sand, and attempting to do so can cause injury.

As described earlier under Objects and Advantages, easy removal of the four sand anchors required to secure a portable volleyball net will add to the enjoyment of beach volleyball. Also, anticipating easy removal of anchor base 10 from the sand, volleyball players will feel comfortable burying anchor base 10 a bit deeper in the sand, thus adding to the net's stability and lessening the chance of it becoming loose during play. Most important, however, the easy-up sand anchor can prevent injury which might otherwise occur from attempting to pull conventional sand anchors to the surface. Despite the difficulty and danger of doing so, attempting to pull conventional sand anchors (FIG. 1) to the surface with anchor line 38 is often the unwise choice of a tired volleyball player, when faced with the alternative of digging four anchors free.

In the following operational description of the advanced form Easy-Up Sand Anchor (FIG. 3), further functional improvement and advantage over conventional sand anchors will be presented.

The advanced form Easy-Up Sand Anchor (FIG. 3) performs all functions of the basic form Easy-Up Sand Anchor discussed above. In the advanced form, however, removal of anchor base 10 from the sand by pulling up on handle 26 in made easier by the paddle shape of anchor base 10 and the slightly sharpened edge 18 at the narrower part of anchor base 10. Both features serve to further reduce sand weight and resistance as anchor base 10 is pulled to the surface. Moreover, the curved paddle shape of anchor base 10 permits it to serve another important function. Anchor base 10 functions as a very effective hand-held shovel for digging the hole into which it will be buried, This eliminates the inconvenience, for example, of volleyball players having to bring a shovel to the beach, thus further enhancing the enjoyment of this fast growing sport.

A further functional improvement and advantage of the advanced form Easy-Up Sand Anchor (FIG. 3) pertains to the configuration of its lines. Connecting line 30, from handle 26 to the lower, closed end of S hook 34, provides for convenient and safe positioning of easy-up line 22 during use of the advanced form Easy-up Sand Anchor, preventing it from being lost in the sand or from causing someone to trip and fall.

CONCLUSION, RAMIFICATIONS AND SCOPE OF THE INVENTION

Thus the innovative features of the advanced form Easy-Up Sand Anchor (FIG. 3) offer significant functional improvement over conventional sand anchors. The functional improvements include easy removal from the sand by use of easy-up line 22 and a curved, paddle shaped anchor base 10 which permits anchor base 10 to function as an effective hand-held shovel. In the case of the fast growing sport of beach volleyball, these functional improvements will serve to enhance the enjoyment of this sport by greatly facilitating both anchor burial and removal. More important, however, for securing volleyball nets and for all other sand anchor applications, the Easy-Up Sand Anchor will reduce potential injuries which might otherwise occur from unwise attempts to pull conventional sand anchors to the surface.

While my above description contains many specifications, these should not be construed as limitations on the scope of the invention, but rather as explanations of one preferred embodiments thereof. Many other variations are possible. For example, anchor base 10 can take any flat or curved shape, such as square, triangular or oblong, provided that easy-up line 22 connects to anchor base 10 near its outer edge. Nor is use of the Easy-Up Sand Anchor limited to securing beach volleyball nets. It is a general purpose sand anchor. In addition to securing volleyball nets, this invention will have a wide variety of sand or soft earth anchoring applications, including but not limited to the securing of badminton nets, tent or tent-like umbrellas, lifeguard stands, and small boats or buoys on land or in shallow water near land. Accordingly, the scope of the invention should be determined not by the embodiments illustrated, but by the appended claims and their legal equivalents.

I claim:

1. A sand anchor, comprising:

(a) an anchor base, wherein the shape of said anchor base is such that said anchor base serves as a hand-held shovel for digging the hole into which it will be placed, (b) an anchor line, (c) a means for joining one end of said anchor line to said anchor base, approximately at the center of said anchor base, (d) a hook, (e) a means for joining said hook to the other end of said anchor line, (f) an easy-up line, (g) a means for joining one end of said easy-up line to said anchor base, approximately at an edge of said anchor base, (h) a handle, (i) a means for joining said handle to the other end of said easy-up line, and (j) a connecting line from said handle to said hook, whereby said sand anchor is used by burying said anchor base horizontally in the sand and attaching said hook to an object to be secured, and said anchor base is removed from the sand by disconnecting said hook from said object to be secured and pulling up on said handle, thus shifting said anchor base from a horizontal to an approximately vertical position to permit said anchor base to be easily pulled to the surface, and whereby the purpose of said connecting line is to provide for convenient and safe positioning of said easy-up line during use of said sand anchor.

2. The sand anchor of claim 1, wherein:

(a) said anchor base is paddle shaped, (b) said anchor line is joined to said anchor base, approximately at the center of its wider part, and (c) said easy-up line is joined to said anchor base, approximately at the end of its narrower part, whereby the paddle shape of said anchor base provides the ability of said anchor base to serve as a hand-held shovel and further reduces sand resistance as said handle is used to pull said anchor base to the surface by said end of its narrower part.

3. The sand anchor of claim 2, wherein said anchor base is curved, whereby the curvature of said anchor base enhances the ability of said anchor base to serve as a hand-held shovel for digging the hole into which it will be placed.

4. The sand anchor of claim 1, wherein said anchor base is curved, whereby the curvature of said anchor base provides the ability of said anchor base to serve as a hand-held shovel for digging the hole into which it will be placed.

5. A sand anchor, comprising:

(a) an anchor base, wherein the shape of said anchor base is such that said anchor base serves as a hand-held shovel for digging the hole into which it will be placed, (b) a line, (c) a means for joining one end of said line to said anchor base, approximately at the center of said anchor base, (d) a means for joining the other end of said line to said anchor base, approximately at an edge of said anchor base, (e) a hook, (f) a means for joining said hook to said line at a predetermined point, (g) a handle, and (h) a means for joining said handle to said line at a predetermined point between said hook and the end of said line attached to the edge of said anchor base, whereby said sand anchor is used by burying said anchor base horizontally in the sand and attaching said hook to an object to be secured, and said anchor base is removed from the sand by disconnecting said hook from said object to be secured and pulling up on said handle, thus shifting said anchor base from a horizontal to an approximately vertical position to permit said sand anchor to be easily pulled to the surface.

6. The sand anchor of claim 5, wherein:

(a) said anchor base is paddle shaped, (b) one end of said line is joined to said anchor base, approximately at the center of its wider part, (c) the other end of said line is joined to said anchor base, approximately at the end of its narrower part, (d) said hook is joined to said line at a predetermined point, (e) said handle is joined to said line between said hook and the end of said line attached to the narrower part of said anchor base, whereby the paddle shape of said anchor base provides the ability of said anchor base to serve as a hand-held shovel and further reduces sand resistance as said handle is used to pull said anchor base to the surface by said end of its narrower part.

7. The sand anchor of claim 6, wherein said anchor base is curved, whereby the curvature of said anchor base enhances the ability of said anchor base to serve as a hand-held shovel for digging the hole into which it will be placed.

8. The sand anchor of claim 5, wherein said anchor base is curved, whereby the curvature of said anchor base provides the ability of said anchor base to serve as a hand-held shovel for digging the hole into which it will be placed.

9. A sand anchor, comprising:

(a) an anchor base, (b) a line, (c) a means for joining one end of said line to said anchor base, approximately at the center of said anchor base, (d) a means for joining the other end of said line to said anchor base, approximately at an edge of said anchor base, (e) a hook, (f) a means for joining said hook to said line at a predetermined point, (g) a handle, and (h) a means for joining said handle to said line at a predetermined point between said hook and the end of said line attached to the edge of said anchor base, whereby said sand anchor is used by burying said anchor base horizontally in the sand and attaching said hook to an object to be secured, and said anchor base is removed from the sand by disconnecting said hook from said object to be secured and pulling up on said handle, thus shifting said anchor base from a horizontal to an approximately vertical position to permit said anchor base to be easily pulled to the surface.

10. The sand anchor of claim 9, wherein the shape of said anchor base is such that said anchor base serves as a hand-held shovel for digging the hole into which it will be placed.

11. The sand anchor of claim 10, wherein:

(a) said anchor base is paddle shaped, (b) one end of said line is joined to said anchor base, approximately at the center of its wider part, (c) the other end of said line is joined to said anchor base, approximately at the end of its narrower part, (d) said hook is joined to said line at a predetermined point, (e) said handle is joined to said line between said hook and the end of said line attached to the narrower part of said anchor base, whereby the paddle shape of said anchor base provides the ability of said anchor base to serve as a hand-held shovel and further reduces sand resistance as said handle is used to pull said anchor base to the surface by said end of its narrower part.

12. The sand anchor of claim 11, wherein said anchor base is curved, whereby the curvature of said anchor base enhances the ability of said anchor base to serve as a hand-held shovel for digging the hole into which it will be placed.

13. The sand anchor of claim 10, wherein said anchor base is curved, whereby the curvature of said anchor base provides the ability of said anchor base to serve as a hand-held shovel for digging the hole into which it will be placed.

14. A sand anchor, comprising:

(a) a paddle shaped anchor base, (b) a line, (c) a means for joining one end of said line to said anchor base, approximately at the center of its wider part, (d) a means for joining the other end of said line to said anchor base, approximately at the end of its narrower part, and (e) a means for attaching said line to an object to be secured, at a predetermined point on said line above the joining of said line to said anchor base, approximately at said center of said anchor base, whereby said sand anchor is used by burying said anchor base horizontally in the sand and attaching said line to said object to be secured, and said anchor base is removed from the sand by disconnecting said line from said object to be secured and pulling up on said line from a predetermined point on said line above the joining of said line to said anchor base, approximately at said edge of said anchor base, thus shifting said anchor base from a horizontal to an approximately vertical position to permit said anchor base to be easily pulled to the surface, and whereby the paddle shape of said anchor base provides the ability of said anchor base to serve as a hand-held shovel and further reduces sand resistance as said line is used to pull said anchor base to the surface by said end of its narrower part.

15. The sand anchor of claim 14, wherein said anchor base is curved, whereby the curvature of said anchor base provides the ability of said anchor base to serve as a hand-held shovel for digging the hole into which it will be placed.

* * * * *